US005341704A

United States Patent [19]

Klemm

[11] Patent Number: 5,341,704

[45] Date of Patent: Aug. 30, 1994

[54] DEPTH ADJUSTMENT ASSEMBLY FOR POWER TOOL

[75] Inventor: Robert W. Klemm, Colgate, Wis.

[73] Assignee: Milwaukee Electric Tool Corporation, Brookfield, Wis.

[21] Appl. No.: 4,935

[22] Filed: Jan. 15, 1993

[51] Int. Cl.[5] ..... B25B 23/00

[52] U.S. Cl. ..... 81/429; 81/52

[58] Field of Search ..... 81/52, 54, 429; 408/202, 241 S

[56] References Cited

U.S. PATENT DOCUMENTS

| | | | |
|---|---|---|---|
| 3,834,252 | 9/1974 | Abell et al. . | |
| 4,030,383 | 6/1971 | Wagner | 81/429 X |
| 4,159,050 | 6/1979 | Hopkins, Sr. et al. | 192/34 |
| 4,647,260 | 3/1987 | O'Hara et al. | 408/241 S |
| 4,762,035 | 8/1988 | Fushiya et al. | 81/429 |
| 5,025,903 | 6/1991 | Elligson | 192/83 |

*Primary Examiner*—James G. Smith

*Attorney, Agent, or Firm*—Michael, Best & Friedrich

[57] ABSTRACT

A two-piece depth adjustment assembly for a hand-held power tool. The depth adjustment assembly includes a mounting sleeve which can be snapped onto the housing of the power tool to fix the sleeve relative to the housing and which can also be snapped off the housing. The depth adjustment assembly also includes a locator having external threads engaged with complementary internal threads on the sleeve so that rotation of the locator relative to the sleeve displaces the locator axially forwardly and rearwardly. To maintain the locator in a predetermined angular position relative to the sleeve, the depth adjustment assembly includes indexing means including resilient fingers on the locator and axially extending recesses on the sleeve for releasably housing the fingers. The result is a depth adjustment assembly which does not require an operator to disturb a previously set depth setting when changing tool attachments and which will not slip from the adjusted setting.

19 Claims, 2 Drawing Sheets

DEPTH ADJUSTMENT ASSEMBLY FOR POWER TOOL

BACKGROUND OF THE INVENTION

1. Field of the Invention

The invention relates to hand-held power tools for driving fasteners, and more particularly to hand tools including depth adjustment systems for adjustably controlling the depth to which a fastener is to be driven into a workpiece.

2. Reference to Prior Art

A power screwdriver with a depth adjustment device used to control the depth to which screws are driven into a workpiece is illustrated in FIG. 7 of U.S. Pat. No. 4,647,260 issued Mar. 3, 1987 to O'Hara et al. This depth adjustment device includes a collar that is threaded onto the housing of a power tool and a depth locator that is threaded into the collar using the same threads used to connect the collar to the housing. Ribs and ridges are formed on the collar and the locator, respectively, and are intended to restrict relative rotation between the collar and the locator to maintain the locator at a desired setting. While this arrangement generally permits an operator to maintain a depth setting when the depth adjustment device is positioned on the tool housing, unscrewing the collar from the tool housing, such as to allow tool removal for other fastener applications, causes the depth setting to be lost when the device is replaced on the tool housing. Additionally, removal of the depth adjustment device from the tool housing is time consuming since several turns of the collar are required to accomplish this task. Furthermore, since the collar is rotatable relative to the tool housing, an operator must exercise care to insure that the collar is not moved relative to the tool while adjusting the locator to a desired setting. To prevent the collar from rotating, an operator must use one hand to rotate the locator and the other hand to hold the collar against movement relative to the tool housing.

Another example of a depth adjustment device is also shown in U.S. Pat. No. 4,647,260. In this device a locator is threaded into a collar which can be snapped onto the nose portion of a tool housing. Thereafter, the locator is non-rotatably mounted on the tool housing via cooperating keys and keyways on the tool housing and the locator, respectively. Also, indexing fingers on the collar engage complementary bumps on the tool housing to maintain the collar in a predetermined angular position relative to the housing so as to maintain a desired depth setting. While this arrangement maintains a desired depth setting when the depth adjustment device is mounted on the tool housing, the setting can be lost when the device is removed from the housing since only a threaded connection exists between the collar and the locator. Thus, a desired depth setting can be lost during normal handling of the adjustment device.

SUMMARY OF THE INVENTION

The invention provides a hand-held tool including an improved depth adjustment assembly that can be easily and quickly removed from the tool and replaced on the tool with one hand and a simple snap-action while preserving a previously set depth setting. The depth adjustment assembly includes snap-fit engagement means for mounting the depth adjustment assembly on the tool and self-contained indexing means operable to securely maintain a desired depth setting. The snap-fit engagement means and the indexing means cooperate to permit the depth adjustment assembly to be snapped on and off the tool while preventing the depth setting of the tool from being unintentionally or inadvertently varied.

More specifically, the invention provides a two-piece depth adjustment assembly which is selectively mountable on a tool housing in coaxial relation with a driven tool attachment. The depth adjustment assembly includes a mounting sleeve having an internal annular flange that can be snapped over a retaining ring on the tool housing to thereafter releasably restrain axial movement of the sleeve relative to the tool housing. This arrangement permits the depth adjustment assembly to be easily and quickly snapped on and off the tool housing with one hand. A detent arrangement between the tool housing and the sleeve prevents rotation of the sleeve relative to the tool housing after the sleeve has been snapped thereon. The depth adjustment assembly also includes a hollow locator which extends forwardly from the tool housing to house the tool attachment when the depth adjustment assembly is mounted on the tool. The locator has external threads engaged with complementary internal threads on the sleeve so that rotation of the locator relative to the sleeve displaces the locator axially forwardly and rearwardly to a desired depth setting. To maintain the locator in a predetermined angular position corresponding to this depth setting, indexing means are provided. The indexing means includes resilient fingers on the locator and axially extending recesses on the sleeve for releasably housing the fingers such that the fingers snap into and out of the recesses as the locator is rotated relative to the fixed sleeve. The result is a depth adjustment assembly which does not require an operator to disturb a previously set depth setting when changing tool attachments and which will not slip from the adjusted setting when removed from the tool housing.

Other features and advantages of the invention will become apparent to those skilled in the art upon review of the following detailed description, claims and drawings.

Figure 1:
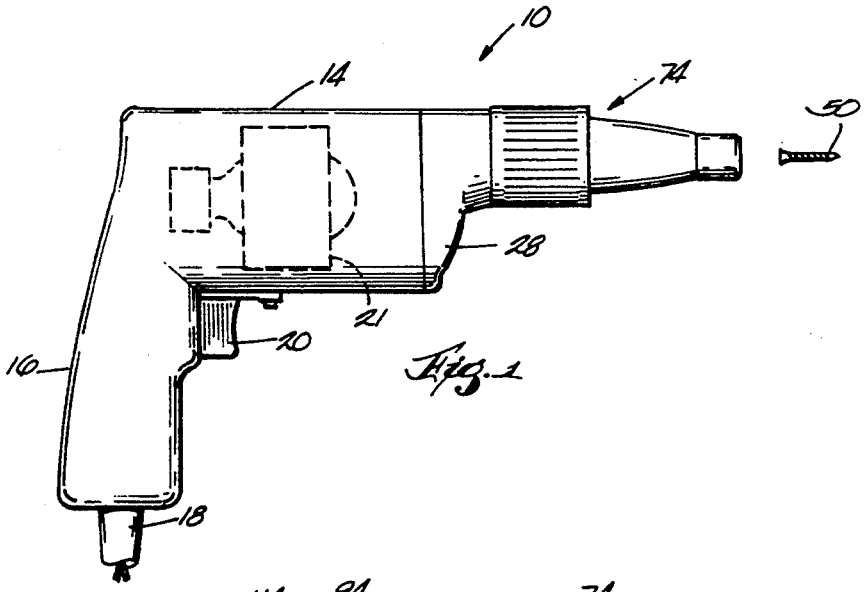
FIG. 1 is a side elevational view of a power tool including a depth adjustment assembly embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that phraseology and terminology used herein is for the purpose of the description and should not be regarded as limiting.

GENERAL DESCRIPTION

Illustrated in FIG. 1 is a hand-held power screwdriver 10 embodying the invention. The screwdriver 10 includes an axis 12 (FIG. 2) and a molded housing 14 having a handle portion 16 from which an electrical power cord 18 extends. A trigger 20 is provided on the handle portion 16 for controlling electric power to a motor 21 in the housing 14. The motor 21 includes an armature shaft 22 (FIG. 2) on which is formed gear teeth to provide a pinion 24.

Figure 2:
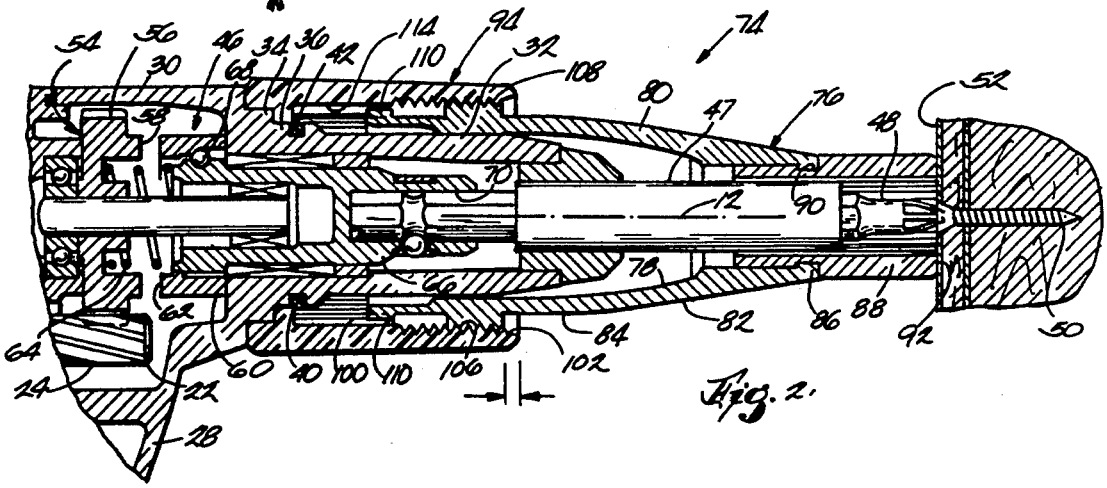
FIG. 2 is an enlarged sectional view of the front portion of the power tool illustrated in FIG. 1 and showing the depth adjustment assembly adjusted to a first depth setting.

The screwdriver 10 also includes a cast nose portion or gear case 28 which forms the front part of the housing 14. As shown in FIG. 2, the gear case 28 includes a main section 30 assembled to the housing 14 and a generally cylindrical section 32 coaxial with the screwdriver axis 12 and extending forwardly from the main section 30. The cylindrical section 32 includes at its base first and second integrally cast ring portions 34 and 36, respectively, forming a stepped configuration between the main section 30 and the cylindrical section 32. For reasons more fully explained below, the first ring portion 34 includes a plurality of circumferentially spaced apart and radially extending male detent members 38 (FIG. 7) and the second ring portion 36 includes an annular groove 40 housing a resilient split retaining ring 42.

The screwdriver 10 also includes a drive mechanism 46 housed in the gear case 28 of the housing 14 for driving a tool attachment including a tool or bit holder 47 and a tool bit 48 housed in coaxial relation within the cylindrical section 32 of the gear case 28. In the illustrated arrangement, the tool bit 48 is used to drive a fastener, such as screw 50, into a workpiece 52 such as drywall. While the drive mechanism 46 could have other constructions, in the specific embodiment illustrated in the drawings the drive mechanism 46 includes a clutch system 54 (shown disengaged). The clutch system 54 includes a main gear 56 which is driven by the pinion 24 on the armature shaft 22 and which has forwardly projecting clutch teeth 58. The clutch system 54 also includes an axially displaceable clutch member 60 having rearwardly projecting clutch teeth 62 that are engageable with the clutch teeth 58 on the main gear 56. A spring 64 is provided to bias the main gear 56 and the clutch member 60 axially apart to disengage the clutch system 54.

The illustrated drive mechanism 46 also includes a spindle 66 which is drivingly engaged by the clutch member 60 through ball members 68 between the clutch member 60 and the spindle 66. The spindle 66 includes a forwardly opening socket 70 for releasably housing the rear end of the tool bit 48.

In operation, the normally disengaged clutch system 54 is engaged when, with the tool bit 48 engaging the screw 50, the screwdriver 10 is moved axially forwardly relative to the screw 50 to cause the spring 69 to compress and the clutch teeth 58 and 62 to mesh. The drive mechanism 46 is then operable to drive the tool bit 48.

Figures 4, 5, 6, 7:
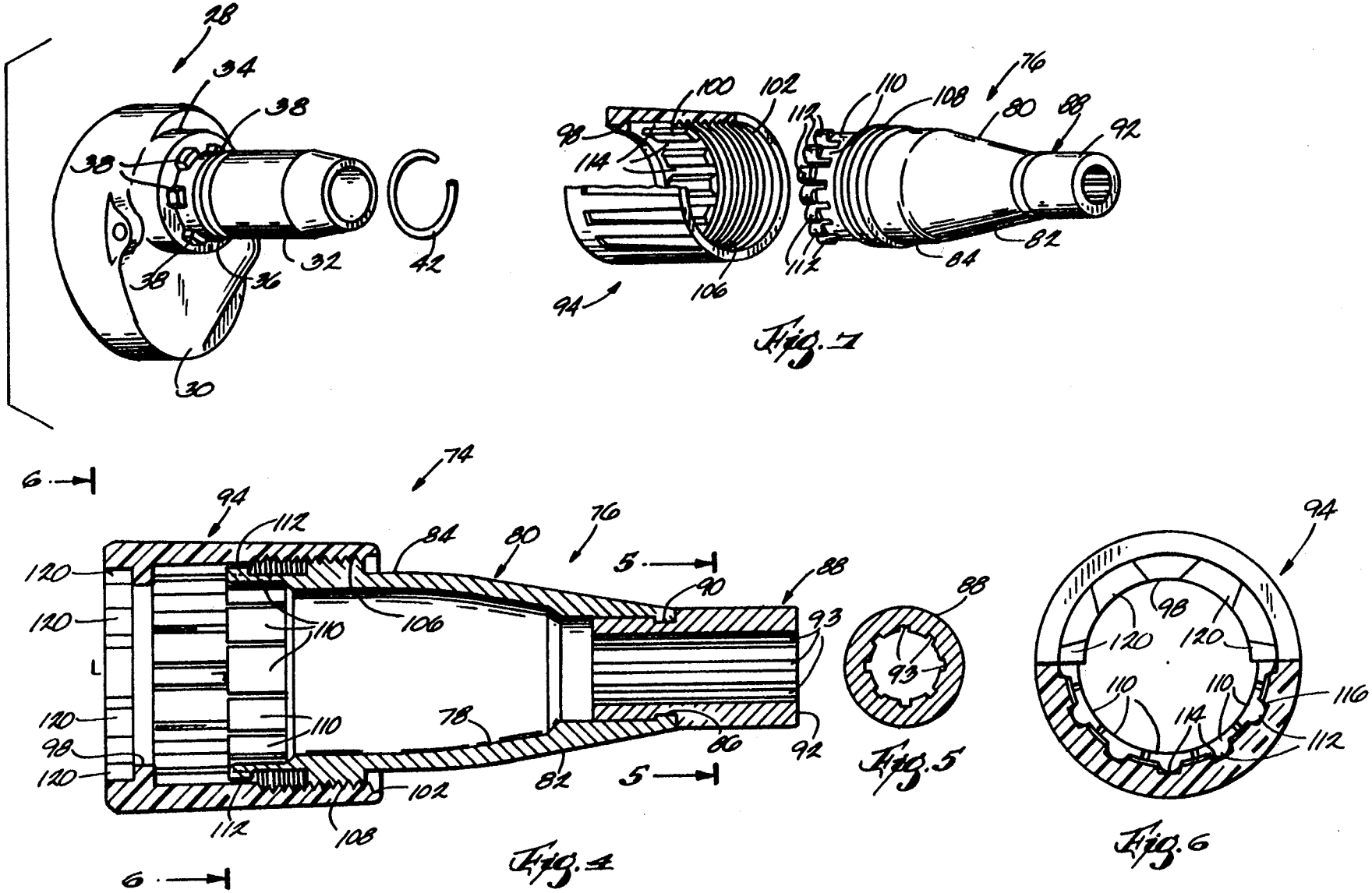
FIG. 4 is a sectional view of the depth adjustment assembly illustrated in FIGS. 2 and 3 after being removed from the remainder of the power tool.
FIG. 5 is a sectional view taken along line 5—5 in FIG. 4.
FIG. 6 is a sectional view taken along line 6—6 in FIG. 4.
FIG. 7 is an exploded perspective view of the depth adjustment assembly illustrated in FIG. 4 and of the interacting gear case and retaining ring.

The screwdriver 10 also includes a depth adjustment assembly 74 for controlling the axial depth to which the screw 50 (or other fastener) is advanced relative to the workpiece 52. As shown in FIG. 4, the depth adjustment assembly 74 includes a depth locator member 76 which has a central bore 78 and which, when the depth adjustment assembly 74 is operably connected to the gear case 28 (see FIGS. 2 and 3), extends axially forwardly from the gear case 28 to house the tool bit 48. The locator 76 includes a molded tubular body 80 having a frustoconically-shaped portion 82 which extends axially forwardly from a cylindrical portion 84 and which includes an annular retaining flange 86 projecting radially inwardly from the inner surface thereof.

The locator 76 also includes a metal insert member 88 having an annular groove 90 into which the retaining flange 86 on the locator body 80 can be molded. The insert member 88 provides a wear surface 92 to abut the workpiece 52 and includes axial slots or grooves 93 in the inner circumference thereof. The axial grooves 93 channel debris, such as gypsum particles for example, away from the rotating bit holder 47 to prevent chattering of the bit holder 47 in the inside diameter of the insert member 88.

The depth adjustment assembly 74 also includes an annular adjustment collar or sleeve member 94 that is preferably molded as a one-piece unit. The sleeve 94 includes an internal flange 98 (FIG. 4) extending radially inwardly from the inner diameter surface thereof. The sleeve 94 also includes a rearward first inner surface portion 100 extending axially forwardly from the internal flange 98 and a second inner surface portion 102 that extends axially forwardly from the first inner surface portion 100 and that has a larger inside diameter than the first inner surface portion 100.

The sleeve 94 and the locator 76 cooperate to provide interconnecting means for adjustably attaching the locator 76 to the gear case 28 so that the axial. position of the locator 76 can be adjusted forwardly and rearwardly to provide operative, secure depth adjustment. More specifically, the interconnecting means includes means for supporting the locator 76 to provide for axial adjustment of the position of the locator 76 relative to the housing 14. While various support means can be employed, in the illustrated arrangement the support means includes internal depth adjusting threads 106 integrally formed on the second inner surface portion 102 of the sleeve 94 and corresponding external threads 108 integrally formed on the outer surface of the cylindrical portion 84 of the locator 76. The locator 76 is thus threaded onto the sleeve 94 such that the axial position of the locator 76 can be varied by rotating the locator 76 relative to the sleeve 94.

To prevent undesired axial displacement of the locator 76 relative to the housing 14, the support means also includes indexing means for maintaining the locator in a predetermined angular position relative to the sleeve 94. In the illustrated arrangement, the indexing means is independent of the housing 14 and is provided between the locator 76 and the sleeve 94. With reference to FIG. 6, the indexing means includes a plurality of circumferentially spaced apart resilient fingers 110 integrally formed with the locator body 80 and projecting rearwardly, in cantilevered relation, from the cylindrical portion 84 thereof. Each of the resilient fingers 110 includes at its distal end a radially outwardly extending tab member 112.

The indexing means also includes a plurality of circumferentially spaced apart, axially extending recesses or grooves 114 in the first inner surface portion 100 of the sleeve 94 and extending forwardly from the internal flange 98. The tab members 112 on the resilient fingers 110 extend radially into the complementary grooves 114 to retain the locator 76 in a desired angular position relative to the sleeve 94. When the locator 76 is rotated by an operator to change the depth setting, the tab members 112 are displaced radially inwardly via engagement with the sides of the grooves 114 to provide a ratcheting action. When the locator 76 has been rotated to the next index position to bring the tab members 112 back into registry with the grooves 114, the resilient fingers 110 return to their normal positions and snap the tab members 112 back into the grooves 114.

To reduce the resistance to rotational movement between the locator 76 and the sleeve 94 presented by the tab members 112, each of the tab members 112 has an arcuate outer surface 116 (FIG. 6). This permits the tab members 112 to smoothly ramp up onto the first inner surface portion 100 as the locator 76 is rotated relative to the sleeve 94. The arcuate outer surfaces 116 also permit the tab members 112 to gradually snap back into the grooves 114 to provide smooth, yet tactiley and audibly detectable ratcheting or indexing. Additionally, the radially outermost points of the tab members 112 are generally equidistant from the screwdriver axis 12 and form a circle having a diameter which is intermediate the diameters of the first and second inner surface portions 100 and 102 of the sleeve 94. This arrangement permits initial engagement of the depth adjusting threads 106 and 108 to assemble the locator 76 to the sleeve 94 without interference from the resilient fingers 110 until the tab members 112 reach the first inner surface portion 100. Thereafter, the resilient fingers 110 and the complementary grooves 114 operably interact.

The support means further includes means for releasably attaching the depth adjustment assembly 74 to the gear case 28. In particular, the attaching means permits an operator to remove the depth adjustment assembly 74 from the gear case 28 without varying the relative axial position of the locator 76 with respect to the gear case 28 when the depth adjustment assembly 74 is subsequently repositioned on the gear case 28. While various means for releasably attaching the depth adjusting assembly 74 to the gear case 28 can be employed, in the illustrated arrangement such means provides a releasable snap-fit engagement between the sleeve 94 and the gear case 28 and includes the internal flange 98 on the sleeve (94 and detent pockets 120 extending axially rearwardly from the internal flange 98 to the rear end of the sleeve 94. The detent pockets 120 are configured to receive the detent members 38 on the gear case 28. To snap the depth adjustment assembly 74 onto the gear case 28, the sleeve 94 is placed around the cylindrical section. 32 of the gear case 28 and pressed axially rearwardly against the gear case 28. As the sleeve 94 nears the main section 30 of the gear case 28, the operator aligns the detent pockets 120 with the detent members 38 and continues to press rearwardly on the sleeve 94 until the internal flange on the sleeve 94 engages and moves over the retaining ring 42 with an audible and tactile "snap". Thereafter, the sleeve 94 is held against rotation by the cooperating detent members and pockets 38 and 120, and is held between the main section 30 of the gear case 28 and the retaining ring 42 against axial movement relative to the housing 14. Since the indexing means (i.e. complementary grooves 114 and fingers 110) is contained entirely within the depth adjustment assembly 74 independently of the snap-action attachment between the sleeve 94 and the gear case 28, the depth setting of the depth adjustment assembly 74 is not disturbed when the depth adjustment assembly 74 is snapped on or off the gear case 28.

In operation, the depth adjustment assembly 74 can be easily snapped on and off the gear case 28 via simple axial motion as described above to facilitate, for example, replacement of the tool bit 48, non-depth controlled work, or removal of a fastener. After the depth adjustment assembly 74 is snapped onto the gear case 28, incremental rotation of the locator 76 relative to the sleeve 94 produces an incremental axial displacement of the locator 76 relative to the housing 14. The tactile and audible "clicks" produced by interaction of the resilient fingers 110 and the grooves 114 provide an indexing or ratcheting mechanism by which a desired depth setting can be easily and quickly set with a high degree of accuracy. Since the depth adjustment assembly 74 operates independently of the remainder of the screwdriver 10, the depth adjustment assembly 74 can be used interchangeably, as a unit, on a variety of tools. Also, if desired, depth adjustment assemblies having various depth ranges can be used interchangeably on the same tool to accomplish virtually any desired depth range regardless of the tool attachment employed.

Figure 3:
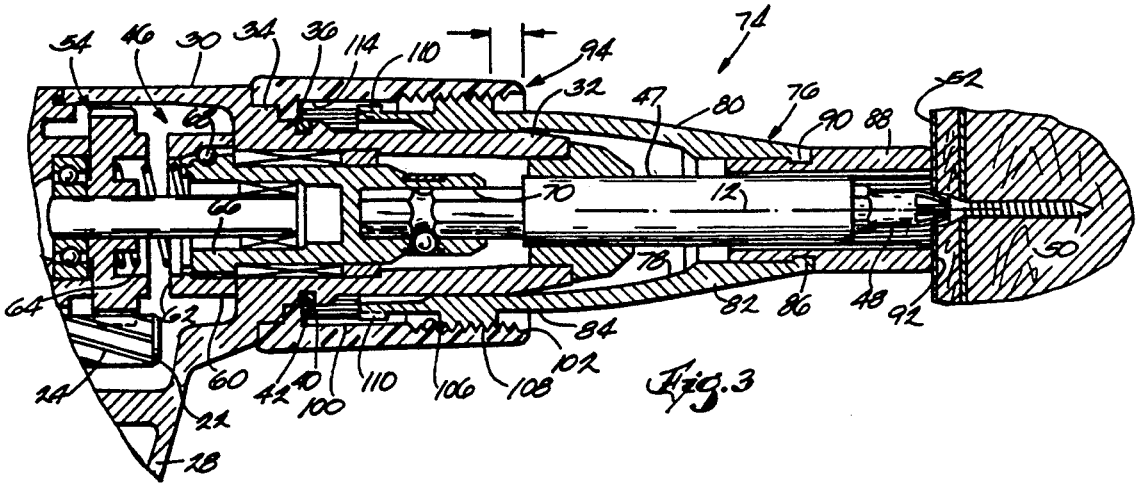
FIG. 3 is a view similar to FIG. 2, but showing the depth adjustment assembly adjusted to a second depth setting to permit deeper penetration of a fastener than is permitted by the depth setting in FIG. 2.

Referring to FIG. 2, the depth adjustment assembly 74 is shown set at a depth nearing its minimum depth setting (i.e. locator 76 nearing outermost position relative to housing 14). When the wear surface 92 of the locator 76 engages the workpiece 52, the clutch system 54 shortly thereafter disengages in a conventional manner to prevent the screw 50 from being driven further into the workpiece 52. At this setting, the wear surface 92 engages the workpiece 52 with the screw head approximately flush with the workpiece 52. Referring to FIG. 3, the depth adjustment assembly 74 is shown set at a depth nearing its greater depth setting (i.e. locator 76 nearing innermost position relative to housing 14) which will yield greater penetration of the screw 50 into the workpiece 52.

While the depth adjustment assembly 74 has been described as part of a power screwdriver 10 employing a tool bit 48, it should be understood that the depth adjustment assembly 74 is useful with a variety of tool attachments including nut-runners, drill bits, etc., and with a variety of power or manually operated tools where depth control is desired.

Advantageously, the invention provides a depth adjustment assembly 74 which can be easily snapped on and off a tool and which functions as a self-contained unit incorporating an independently operable indexing mechanism for preventing the depth adjusting assembly from slipping out of a preselected depth setting until an operator changes the setting. Unlike prior art arrangements, the present arrangement permits an operator to perform servicing, such as tool bit replacement, without disturbing a previously selected depth setting.

A further advantage is achieved by the addition of the axial debris relief grooves 93 which permit debris to empty from the tool 10. The grooves 93 provide a path for debris so that the debris is less likely to impinge directly between the inner circumferential surface of the insert member 88 and the bit holder 47 and to thereby interfere with tool operation.

Various features of the invention are set forth in the following claims.

I claim:

1. A depth adjustment assembly for a hand-held tool, the tool including a housing, the depth adjustment assembly comprising:

a locator adapted to extend forwardly from the housing and having a central bore adapted to house a tool attachment, and means for adjustably attaching the locator to the housing such that the position of the locator can be adjusted forwardly and rearwardly with respect to the housing, the means for adjustably attaching the locator to the housing including means for supporting the locator for rotation with respect to the housing to provide for axial adjustment of the position of the locator with respect to the housing, and the means for adjustably attaching the locator to the housing including means for supporting the locator such that the locator can be removed from the housing without varying the relative axial position of the locator with respect to the housing when the locator is repositioned on the housing.

2. A depth adjustment assembly as set forth in claim 1 wherein the means for adjustably attaching the locator to the housing includes an annular sleeve adapted to be snapped onto the housing, the sleeve supporting the locator.

3. A depth adjustment assembly as set forth in claim 2 wherein the sleeve is supported on the housing such that it is non-rotatable with respect to the housing.

4. A depth adjustment asembly as set forth in claim 2 wherein the means for supporting the locator such that the locator can be removed from the housing without varying the relative axial position of the locator with respect to the housing when the locator is repositioned on the housing includes a plurality of resilient fingers projecting from the locator, and a plurality of complementary recesses provided in the sleeve and adapted to releasably house at least portions of the resilient fingers.

5. A depth adjustment assembly as set forth in claim 4 wherein each of the fingers includes a radially outwardly extending tab member, wherein the sleeve includes an inner surface, and wherein the plurality of recesses are located on the inner surface and releasably house the tab members.

6. A depth adjustment assembly as set forth in claim 2 and further including means for providing a releasable snap-fit engagement between the sleeve and the housing, the means for providing a releasable snap-fit engagement including first detent means for preventing axial movement of the sleeve relative to the housing when the sleeve and the housing are engaged.

7. A depth adjustment assembly as set forth in claim 6 wherein the first detent means includes a resilient ring member on one of the housing and the sleeve for engaging the other of the housing and the sleeve to restrict axial movement therebetween, and wherein the means for providing a releasable snap-fit engagement includes second detent means for preventing relative rotation between the sleeve and the housing when the sleeve and the housing are in snap-fit engagement.

8. A depth adjustment assembly as set forth in claim 1, wherein said locator includs axial slots along a portion of its inner circumference, said inner circumference being adapted to engage the tool attachment.

9. A depth adjustment assembly as set forth in claim 2 wherein the means for supporting the locator for rotation with respect to the housing to provide for axial adjustment of the position of the locator with respect to the housing includes a threaded portion on the locator, and a threaded portion on the sleeve adapted to threadably house the threaded portion of the locator, and wherein the means for supporting the locator such that the locator can be removed from the housing without varying the relative axial position of the locator with respect to the housing when the locator is repositioned on the housing includes a plurality of resilient projections on the locator, the resilient projections being positioned rearwardly of the threaded portion of the locator, and plurality of axially extending spaced apart recesses in the sleeve for releasably housing the resilient projections.

10. A hand-held tool for use with a tool attachment, the hand-held tool comprising:

a tool housing, a depth adjustment assembly releasably supported on the tool housing, the depth adjustment assembly including a locator extending forwardly from the tool housing and having a central bore adapted to house the tool attachment, and means for adjustably attaching the locator to the tool housing such that the position of the locator can be adjusted forwardly and rearwardly with respect to the tool housing, the means for adjustably attaching the locator to the tool housing including means for supporting the locator for rotation with respect to the tool housing to provide for axial adjustment of the position of the locator with respect to the tool housing, and the means for adjustably attaching the locator to the tool housing including means for supporting the locator such that the locator can be removed from the tool housing without varying the relative axial position of the locator with respect to the tool housing when the locator is repositioned on the tool housing.

11. A hand-held tool as set forth in claim 10 wherein the means for adjustably attaching the locator to the tool housing includes an annular sleeve adapted to be snapped onto the tool housing, the sleeve supporting the locator.

12. A hand-held tool as set forth in claim 13 wherein the sleeve is supported on the tool housing such that it is non-rotatable with respect to the tool housing.

13. A hand-held tool as set forth in claim 12 wherein the means for supporting the locator such that the locator can be removed from the housing without varying the relative axial position of the locator with respect to the housing when the locator is repositioned on the housing includes a plurality of resilient fingers projecting from the locator, and a plurality of complementary recesses provided in the sleeve and adapted to releasably house at least portions of the resilient fingers.

14. A hand-held tool as set forth in claim 13 wherein each of the fingers includes a radially outwardly extending tab member, wherein the sleeve includes an inner surface, and wherein the plurality of recesses are located on the inner surface of the sleeve and releasably house the tab members.

15. A hand-held tool as set forth in claim 11 and further including means for providing a releasable snap-fit engagement between the sleeve and the tool housing, the means for providing a releasable snap-fit engagement including first detent means for preventing axial movement of the sleeve relative to the tool housing when the sleeve and the tool housing are engaged.

16. A hand-held tool as set forth in claim 15 wherein the first detent means includes a resilient ring member engageable with each of the tool housing and the sleeve to restrict axial movement between the tool housing and the sleeve, and wherein the means for providing a releasable snap-fit engagement includes second detent means for preventing relative rotation between the sleeve and the tool housing when the sleeve and the housing are in snap-fit engagement.

17. A hand-held tool as set forth in claim 11 wherein the means for supporting the locator for rotation with respect to the housing to provide for axial adjustment of the position of the locator with respect to the housing includes a threaded portion on the locator, and a threaded portion on the sleeve adapted to threadably house the threaded portion of the locator, and wherein the means for supporting the locator such that the locator can be removed from the housing without varying the relative axial position of the locator with respect to the housing when the locator is repositioned on the housing includes a plurality of resilient projections of the locator, the resilient projections being positioned rearwardly of the threaded portion of the locator, and a plurality of axially extending spaced apart recesses in the sleeve for releasably housing the resilient projections.

18. A hand-held tool for use with a tool attachment to drive fasteners relative to a workpiece, the hand-held tool comprising:

a tool housing, a depth adjustment assembly including an annular sleeve having a threaded portion and means for providing a releasable snap-fit engagement between the sleeve and the tool housing, the means for providing a releasable snap-fit engagement including first detent means for preventing axial movement of the sleeve relative to the tool housing when the sleeve and the tool housing are in snap-fit engagement and second detent means for preventing relative rotation between the sleeve and the tool housing when the sleeve and the housing are in snap-fit engagement, a locator extending forwardly from the tool housing and defining a central bore adapted to house the tool attachment, the locator including a threaded portion threadably housed by the threaded portion of the sleeve such that the relative housing can be adjusted forwardly and rearwardly by rotating the locator with respect to the the tool housing, and indexing means between the locator and the sleeve, the indexing means includes a plurality of resilient fingers projecting from the locator and a plurality of complementary recesses provided in the sleeve to releasably house at least portions of the resilient fingers.

19. A hand-held tool for driving a fastener into a workpiece, said tool comprising:

a housing, a drive meachanism housed in said housing and including a tool attachment extending from said housing and being adapted to drive the fastener relative to the workpiece, and means supported on said housing for controlling the axial depth to which the fastener is driven relative to the workpiece, said means for controlling the depth to which the fastener is driven including an annular sleeve, and a locator extending forwardly from the tool housing and defining a central bore adapted to house the tool attachment, said locator including an inner surface having a cylindrical inner surface portion, said cylindrical inner surface portion having an axial length, and said cylindrical inner surface portion being engageable with said tool attachment along its entire axial length, and axial extending grooves in said cylindrical inner surface portion and extending the axial length thereof, and one of said sleeve and said locator being moveable to adjustment the position of the locator forwardly and rearwardly with respect to said housing.

* * * * *